United States Patent [19]

Benoit et al.

[11] Patent Number: 4,665,635

[45] Date of Patent: May 19, 1987

[54] FRICTION INSERT FOR SKI BOOT

[75] Inventors: Louis Benoit, Frangy; Claude Perrissoud, Sevrier, both of France

[73] Assignee: Salomon S. A., Annecy, France

[21] Appl. No.: 737,608

[22] Filed: May 24, 1985

[30] Foreign Application Priority Data

May 25, 1984 [FR] France ..... 84 08804

[51] Int. Cl.[4] ..... A43B 5/04

[52] U.S. Cl. ..... 36/120; 36/117

[58] Field of Search ..... 36/117, 119, 120, 121, 36/118

[56] References Cited

U.S. PATENT DOCUMENTS

| | | | |
|---|---|---|---|
| 3,593,435 | 7/1971 | Lange | 36/120 |
| 3,786,581 | 1/1974 | Mochizuki | 36/121 |
| 3,968,578 | 7/1976 | Rathmell | 36/121 |
| 3,988,842 | 11/1976 | Rathmell | 36/121 |
| 4,043,059 | 8/1977 | Rathmell | 36/121 |
| 4,060,256 | 11/1977 | Collombin et al. | 36/117 X |
| 4,095,356 | 6/1978 | Robran et al. | 36/121 |
| 4,152,849 | 5/1979 | Frechin et al. | 36/1.5 X |
| 4,282,658 | 8/1981 | Hanson et al. | 36/121 |
| 4,381,613 | 5/1983 | Lederer | 36/121 |

*Primary Examiner*—Werner H. Schroeder
*Assistant Examiner*—T. Graveline
*Attorney, Agent, or Firm*—Pollock, Vande Sande & Priddy

[57] ABSTRACT

Ski boot comprising an upper (3) at least partly articulated on a shell base (2), a tightener (15) for closing the boot on the foot, and a sliding block (1) attached in eventually demountable manner on the shell base (2), substantially in the region (22, 70) adjacent to the kick zone, the sliding block being constituted of a thin plate whose form corresponds approximately to the curved surface swept by the periphery of the lower edge (25) of the upper subjected to various flexure movements with respect to the shell base.

8 Claims, 10 Drawing Figures

FRICTION INSERT FOR SKI BOOT

FIELD OF THE INVENTION

The present invention relates to ski boots whose upper is articulated and/or flexible on the base of the shell, and in particular to sliding means placed into operation at the level of joints between these parts of the boot.

BACKGROUND OF THE INVENTION

Known ski boots of this types are generally provided with relative "aft to fore" flexibility, at the portion adjacent the kick region, in order to permit deflection of the leg of the skier with respect to the ankle in case of pressures applied on the sole of the boot. In effect, it has been realized that, during the normal practice of downhill skiing, and particularly in competition, certain stresses were susceptible of causing tripping of the safety bindings of the ski, while controlled flexion the upper of the said boot sufficed to compensate thenm, and this without danger to the skier. It is for this reason that, in most of the known ski boots, the flexure zones have been arranged at a distance from the points of articulation between the base of the shell and the upper; generally the flexure is controlled either by elastic deformation of a portion of the boot, or through the intermediary of an elastic device offering a certain resistance, sometimes progressive, to inclination of the upper toward the front of the boot.

In all these boots, it has appeared necessary to form perfect joints between the constituent elements susceptible to displacement relative to one another during flexures of the upper, while retaining optimal sliding quality compatible with the restraints and pressures to which they were subjected. It is thus that these boot elements, base of the shell, upper and/or flap are made, first, of materials having very good mechanical characteristics, and second, with forms obtained by molding and/or by machine finishing, specific to the joints to be produced. These boots turn out to be difficult to manufacture, due to the fact that the sliding zones must be prepared prior to mounting of the different parts of the boots, that their particular forms require more or less complex and expensive molding and/or machine finishing processes, and that the materials used have a higher cost than those which can be used for the rest of the other parts of the boot not subjected to such particular and elevated stresses.

This is the case with the boot described in U.S. Pat. No. 4,095,356. In effect, the upper of the boot, connected to the base of the shell by means of pivots, is articulatedly mounted on the latter with a degree of limited freedom of deflection by a resilient device interposed between them. The sliding zones are obtained in this case in monobloc fashion respectively with the upper and the base of the shell, and tightness is assured by the resilient device introduced into the housings also provided in the upper and the base of the shell. On the other hand, according to French Pat. No. 2,256,734, the sliding zones are obtained on the portion adjacent to the kick region, respectively on the upper and the base of the shell, in such manner as to overlap one another, and a resilient device, assuring the connection between the said upper and the base of the shell, enables control of the flexibility.

SUMMARY OF THE INVENTION

The sliding block, object of the invention, makes it possible to avoid the disadvantages noted above in a simple and effective manner. In effect, obtained independently of the other constituent parts of the boot and adjustable very easily on the base of the shell, it is executed to make the junction between the upper and the said base of the shell, particularly in the flexure zone correspondingly to the kick zone of the foot of the skier. According to the construction of the boot and the position of the upper shell base articulation axis, the block is preferably shaped in a manner approximately concentric with the said axis. In other boots where the flexure control is conveyed not by pivoting of the upper but by rectilinear displacement, for example of the base of the upper on the kick zone, the block is shaped, in this case, in the direction of the said displacement. On the other hand, it is also possible to put in place a sliding block whose upper generatrix of the said block comprises a trajectory which is engaging with respect to the pivoting movement of the lower edge of the forward part of the upper, such that a progressive stiffening is produced in proportion to the flexures.

In accordance with a preferred embodiment of the invention, the block is fixed on the boot simply by fitting in a housing arranged on the base of the shell.

According to other embodiments, the block is made fast by a mechanical means, such as a rivet, on the base of the shell, by gluing or welding.

BRIEF DESCRIPTION OF THE DRAWINGS

The invention will be better understood by reference to the detailed description which follows, with reference to the attached drawings, showing by way of non-limiting examples, preferred embodiments of the friction block.

Figure 1:
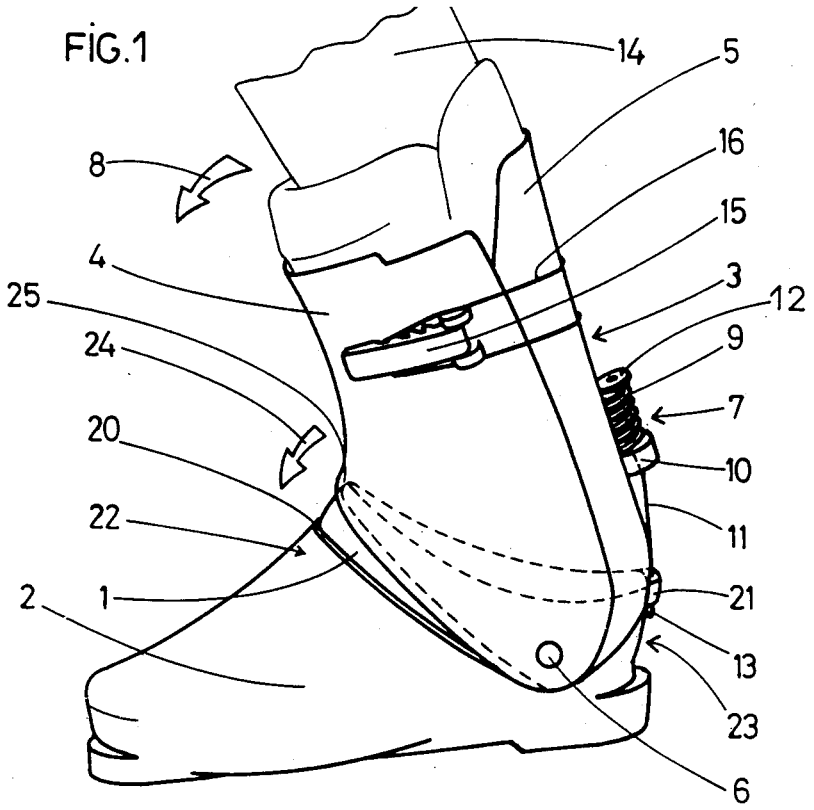
FIG. 1 shows a ski boot provided with a friction block in accordance with a first embodiment of the invention.
Figure 2:
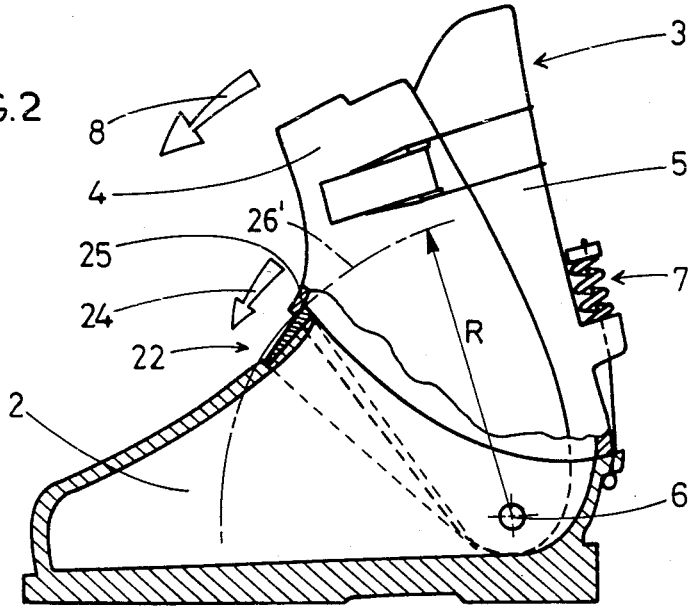
FIG. 2 is a partial section view of the boot according to FIG. 1, cut along its longitudinal axis.

According to FIG. 1, the sliding block 1 is adapted to a ski boot having a rigid shell 2 and a foot entry at the rear. In this type of boot, the upper is composed of two elements, a forward part 4 and a spoiler 5, articulatedly mounted on the base of shell 2 about a transverse horizontal axis 6, which respectively constitute the forward and rearward support for the base of the leg 14 of the skier on the boot. Abutments 20 and 21, respectively arranged on the side adjacent to the kick zone 22 and at the level of the heel 23, determine the pivoting amplitude of the upper 3. The sliding block 1 is intercalated between forward part 4 and the base of the shell 2, at the junction of these two parts, and covers the zone of deflection which forward part 4 is susceptible of traversing along the direction of arrow 24 when the base of the leg 14 of the skier exercises a flexure illustrated by arrow 8 on the upper 3. Control of the flexure of the upper 3 is obtained, in the case of the figure shown, by means of a known elastic device 7, comprising, for example, a spring 9, a support housing 10 fast with the spoiler 5, a cable 11 passing through the spring to hook on a stop pin 12 and retained by its other end 13 on the base of the shell 2. Closure of the upper 3 is assured through the intermediary of a tightener 15 associated with a cable 16 hooked on forward part 4 and surrounding spoiler 5. It will be understood from FIGS. 1 and 2 that when forward part 4 is pulled in flexure and pivots about its axis 6, spoiler 5 will be entrained in the movement against the retaining action of elastic device 7, and the lower edge 25 of the said flap will be displaced on the upper portion of the base of the shell in the kick zone, in a manner approximately concentric to the axis 6. In order that tightness between the base of the shell 2 and forward part 4 may be achieved, sliding block 1 is arranged so as to present a surface substantially concentric to the pivoting axis 6 of upper 3 on the entire flexure zone adjacent to the kick zone 22. Preferably, forward part 4 is so mounted on the shell base 2 that the periphery of its lower lower edge 25 exerts a certain pressure on the sliding block 1.

Figure 3:
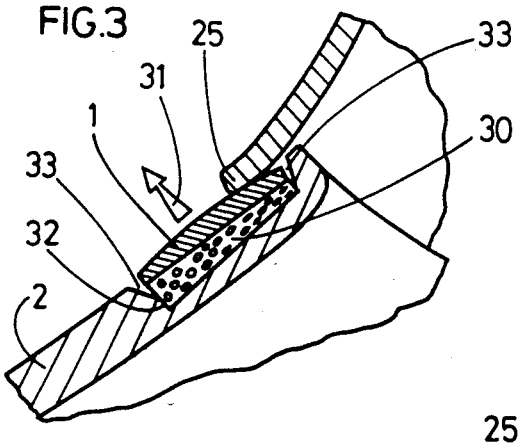
FIGS. 3 and 4 are partial section views showing constructional details of the block, object of the invention.

In another fashion (FIG. 3), a resilient element 30, such as an elastomeric foam, is interposed between the shell base 2 and the block 1, in such manner that the latter is permanently drawn, in direction 31, against the lower edge 25 of forward part 4. The block 1 having in this case a relative mobility with respect to shell base 2, the housing 32 in which it is partly engaged is widened out at its edges 33, and resilient element 30 is fixed thereto on the shell base, for example by gluing.

Figure 4:
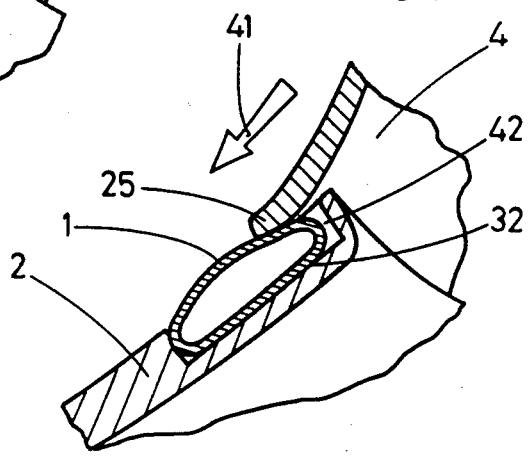

According to another embodiment (FIG. 4), sliding block 1 is made of an elastically deformable shaped material; in the case of the illustrated figure, the housing 32 provided in shell base 2 is substantially larger than the block in order to allow the deformation which the latter is susceptible to undergoing when forward part 4 is drawn in direction 41.

Figure 6:
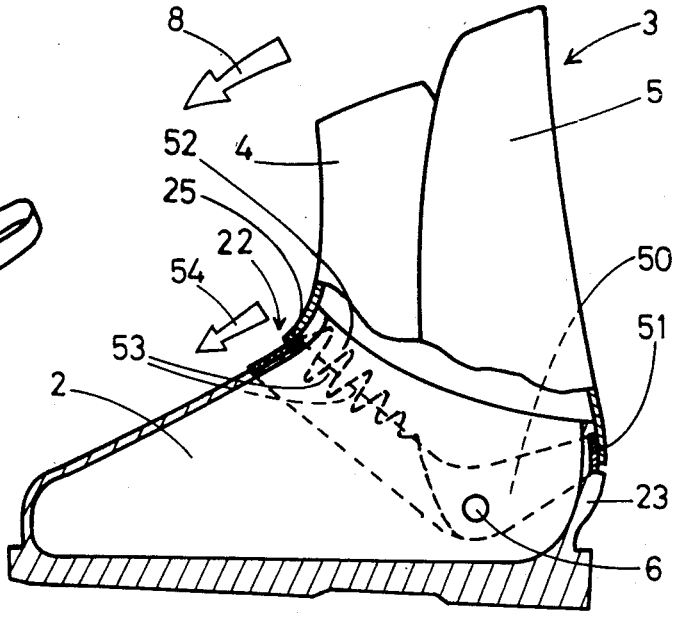
FIG. 6 is a longitudinal section view of a boot comprising a block according to another embodiment arranged on the periphery of the base of the shell.
Figure 7:
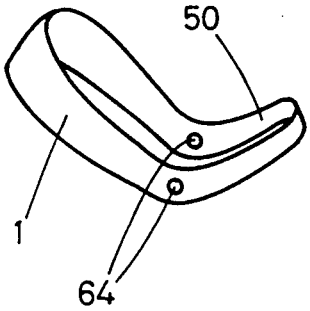
FIG. 7 is another perspective view of a sliding block according to FIG. 6 to be adapted to the entire lower periphery of the upper, also assembled to the shell at the level, for example, of the articulation axes.

According to another embodiment of the invention (FIGS. 6 and 7), the sliding block 1 comprises a rearward extension 50 (FIG. 7) covering the friction zone which extends at the level of the heel 23 of the ski boot between the lower rear edge 51 of spoiler 5 and the shell base 2, thus constituting a perfect joint between upper 3 and the said shell base 2. In this example, flexure control in direction 8 is obtained through the intermediary of forward part 4 which is provided in a zone 52 elastically deformable through slots 53. Upon drawing part 4 forward into abutment, the same pivots in direction 8 and its forward edge slides on block 1 in direction 54, causing more or less of a deformation of slots 53, proportional to the flexure force.

Figure 5:
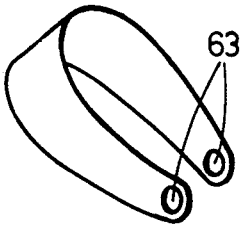
FIG. 5 is a perspective view of a sliding block intended to be made fast with the base of the shell by ears which adapt themselves to the axes of articulation of the upper of the boot according to the invention.

It will be understood that, for all these embodiments, the sliding blocks may be provided with attachment means on the shell base through the intermediary of ears 63 (FIG. 5) and 64 (FIG. 7) which are mounted on the articulation axes (6) of the uppers of the boots according to the invention.

Figure 9:
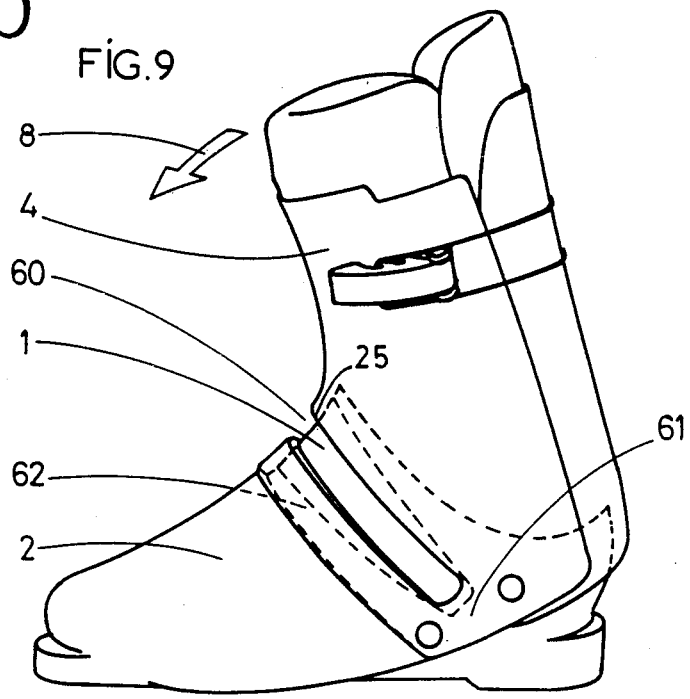

Further (FIG. 9), the sliding block 1 is adapted for a ski boot the forward edge 25 of whose upper forward part 4 is immobilized on shell base 2; a transverse opening 60 arranged on forward part 4 permits flexion of the latter in direction 8, the permissible flexure force being determined by the imperforate portion 61 and the mechanical properties of the material constituting the forward part. In this embodiment, the block is preferably fitted on the shell base and maintained in its housing 62 by forward part 4.

Figure 8:
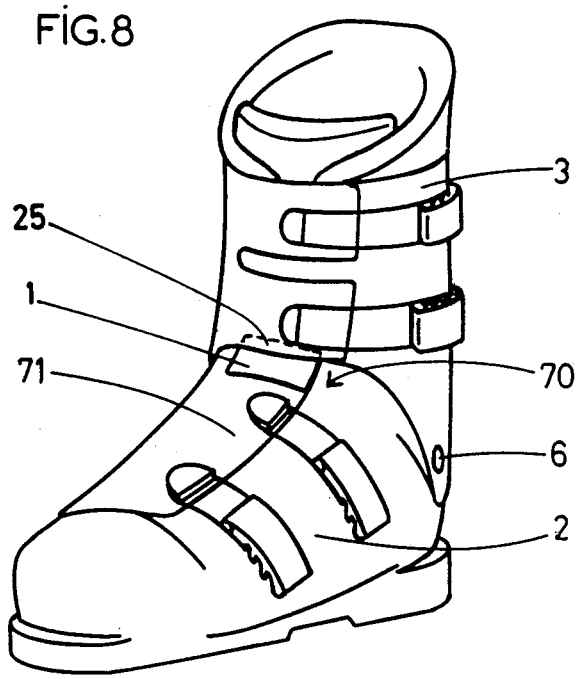
FIGS. 8 and 9 show sliding blocks adapted to other types of boots.

Clearly (FIG. 8). sliding block 1 may be mounted on boots of the type having their opening at the top.

In these boots, upper 3 is constituted by a single element which surrounds the lower leg of the skier and is articulatedly mounted on the shell base 2 about a transverse horizontal axis. The sliding zone 70 adjacent the kick region being, in this type of boot, more particularly localized on the overlapping portion of the shell base, the sliding block 1 is joined together only with the latter.

Figure 10:
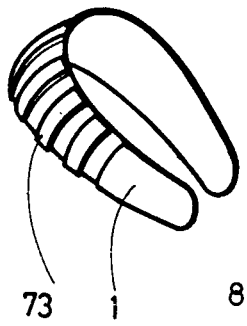
FIG. 10 shows a sliding block having striations.

The invention is not limited to sliding blocks whose curved surface of contact with the upper is smooth, but also comprises sliding blocks whose curved contact surface comprises striations 73 parallel to the longitudinal axis of the boot (FIG. 10), such that the low level friction coefficient due to the material used for the said block is further reduced because of the reduction in the surface cooperating with the forward part of the upper.

We claim:

1. Ski boot comprising an upper having at least one part which is articulated with respect to a shell base, means of closing said upper on the lower part of the leg of the skier, comprising a sliding block (1) having a curved surface and being located between said upper (3) and said shell base (2) at least in the region substantially corresponding to the instep zone (22, 70) of the boot, the generatrix passing through the median longitudinal plane of said curved surface of said sliding block being approximately concentric to the axis of articulation of said upper on said shell base, said sliding block being compressed in a transverse direction upon flexure of said upper relative to said shell base and constituting at all times a leakproof joint therebetween while also retaining optimal sliding movement during such flexure.

2. Ski boot comprising an upper having at least one part which is articulated with respect to a shell base, means of closing said upper on the lower part of the leg of the skier, comprising a sliding block (1) having a curved surface and being located between said upper (3) and said shell base (2) at least in the region substantially corresponding to the instep zone (22, 70) of the boot, the generatrix passing through the median longitudinal plane of said curved surface of said sliding block determining a trajectory engaging the lower edge of the forward part of said upper with respect to said shell base, said sliding block being compressed in a transverse direction upon flexure of said upper relative to said shell base and constituting at all times a leakproof joint therebetween while also retaining optimal sliding movement during such flexure.

3. Ski boot comprising an upper having at least one part which is articulated with respect to a shell base, means of closing said upper on the lower part of the leg of the skier, comprising a sliding block (1) having a curved surface and being located between said upper (3) and said shell base (2) at least in the region substantially corresponding to the instep zone (22, 70) of the boot, the generatrix passing through the median longitudinal plane of said curved surface of said sliding block being approximately concentric to the axis of articulation of said upper on said shell base.

4. Ski boot according to claim 3, wherein said sliding block (1) is constituted by a plate having a curved surface whose form corresponds at least partly to the curved surface swept by a lower edge (25) of a forward portion of said upper (3, 4) during flexure movements of the latter with respect to said shell base.

5. Ski boot claim 4, wherein said sliding block (1) is housed in a cavity (32) provided in the upper portion of said shell base adjacent said instep zone.

6. Ski boot according to claim 5, wherein said sliding block (1) forms a projection on the upper part of said shell base adjacent said instep zone, while the lower portion of the forward part of said upper comprises a clearance corresponding to the entire projection formed by said block.

7. Ski boot according to any one of claims 3 to 6, wherein said sliding block (1) extends on either side of the upper portion of said shell base adjacent to said instep zone, in the direction of the articulation axes (6) of said upper on said shell base, and is extended by hooking ears (63, 64) on said articulation axes.

8. Ski boot according to any one of claims 4 to 6, wherein the generatrix passing through the median longitudinal plane of said curved surface of said sliding block describes a trajectory engaging the lower edge of the forward part of said upper with respect to said shell base.

* * * * *